US008907806B2

(12) United States Patent
Kim

(10) Patent No.: US 8,907,806 B2
(45) Date of Patent: Dec. 9, 2014

(54) ROAD GUIDE APPARATUS FOR A VISUALLY IMPAIRED PERSON

(76) Inventor: Ji Hoon Kim, Daegu (KR)

( * ) Notice: Subject to any disclaimer, the term of this patent is extended or adjusted under 35 U.S.C. 154(b) by 152 days.

(21) Appl. No.: 13/383,834

(22) PCT Filed: Jul. 13, 2010

(86) PCT No.: PCT/KR2010/004534
§ 371 (c)(1),
(2), (4) Date: Jan. 12, 2012

(87) PCT Pub. No.: WO2011/007999
PCT Pub. Date: Jan. 20, 2011

(65) Prior Publication Data

US 2012/0112876 A1 May 10, 2012

(30) Foreign Application Priority Data

Jul. 13, 2009 (KR) ..... 10-2009-0063517

(51) Int. Cl.
*G08B 5/00* (2006.01)
*A61H 3/06* (2006.01)

(52) U.S. Cl.
CPC ..... *A61H 3/061* (2013.01); *A61H 2201/5058* (2013.01)
USPC ..... 340/691.1

(58) Field of Classification Search
USPC ..... 340/4.14, 10.1, 691.1, 550; 382/114; 701/200; 704/271
See application file for complete search history.

(56) References Cited

FOREIGN PATENT DOCUMENTS

| | | | |
|---|---|---|---|
| CN | 201194114 | Y | 2/2009 |
| CN | 101385676 | A | 3/2009 |
| EP | 2455046 | B1 | 1/2011 |
| JP | 06-343669 | | 12/1994 |
| JP | 2000-084018 | | 3/2000 |
| JP | 2004-309305 | A | 4/2004 |
| KR | 10-2007-0114637 | | 12/2007 |
| KR | 10-2009-0020857 | | 2/2009 |

OTHER PUBLICATIONS

International Search Report for PCT/KR2010/004534 Mailed on April 25, 2011.

*Primary Examiner* — Vernal Brown
(74) *Attorney, Agent, or Firm* — AKC Patents, LLC; Aliki K. Collins

(57) ABSTRACT

A road guide apparatus for a visually impaired person, which not only senses the yellow color of Braille blocks installed on a road to guide the visually impaired person, but also reads information from an RFID tag to guide the visually impaired person. The road guide apparatus for a visually impaired person comprises a road sensing apparatus including a handle, wheels attached to a main body of the apparatus, a handle rod fixed at the main body via hinge, and a control unit installed within the main body and connected to a yellow color sensing unit and a tag sensing unit.

1 Claim, 3 Drawing Sheets

ROAD GUIDE APPARATUS FOR A VISUALLY IMPAIRED PERSON

RELATED APPLICATIONS

This application is a 371 application of International Application No. PCT/KR2010/004534, filed Jul. 13, 2010, which in turn claims priority from Korean Patent Application No. 10-2009-0063517, filed Jul. 13, 2009, each of which is incorporated herein by reference in its entirety.

TECHNICAL FIELD

The present invention relates to a road guide apparatus for a visually impaired person, and more particularly, to a road guide apparatus for a visually impaired person which not only senses the yellow color of a Braille block installed on a road to guide the visually impaired person, but also reads information from an RFID tag to guide the visually impaired person.

BACKGROUND ART

A visually impaired person walks mostly with a stick or with the support of a guide dog, and is guided with Braille blocks installed on a road when he/she walks.

A guide dog may not be trusted 100% for any unexpected circumstances even if the dog is well trained. Also, even if the Braille blocks are installed, the visually impaired person may feel difficult and walk slow following the Braille blocks.

If the visually impaired person approaches a roadway by mistake, accident may occur due to a passing vehicle.

A guard rail should be installed between a sidewalk and a road to prevent the visually impaired person from approaching the road, but there are many issues in installing the guard rail in cities and many difficulties are associated with the guard rail, and thus the guard rail is not installed usually.

Also, there may be trash bins or other installations in the boundary between the roadway and the road, the visually impaired person may feel difficult while walking.

Accordingly, it is essential to inform the visually impaired person of the information on such installations.

To help the visually impaired person walk without difficulty, a stick with a built-in RFID reader has been developed to read an RFID tag installed within Braille blocks and guide the condition and information of a road.

However, the RFID tag is slow in response time and thus the visually impaired person should frequently stop walking, and the existing Braille blocks are not utilized well. The Braille blocks are the most fundamental means for guiding the visually impaired person and may guide the visually impaired person when the RFID tag or receiver has a problem. However, it is difficult for the visually impaired person to walk only with the sense of the sole of the foot. That is, if the visually impaired person wears shoes with a thick sole, he/she may not sense the Braille of the Braille blocks.

Also, as vehicles should pass by a pedestrian crossing, it is difficult to install the Braille blocks on the pedestrian crossing.

DISCLOSURE

Technical Problem

The present invention has been made to solve the problems and it is an object of the present invention to provide a road guide apparatus for a visually impaired person which not only senses an RFID tag but also the yellow color of a Braille block and guides the visually impaired person.

It is another object of the present invention to provide a road guide apparatus in which a yellow color guide line is formed in a pedestrian crossing where a Braille block cannot be installed, to thereby guide the visually impaired person without hindering the driving of vehicles.

Technical Solution

In order to achieve the object of the present invention, a road guide apparatus for a visually impaired person which comprises a road sensing apparatus comprises a handle and wheels attached to a main body of the road sensing apparatus, a handle rod fixed at the main body via hinge, and a control unit installed within the main body and connected to a yellow color sensing unit and a tag sensing unit, and the yellow color sensing unit senses the yellow color of a Braille block or a yellow line and transmits a signal to the control unit, and the tag sensing unit senses a signal of the RFID tag installed on the road and transmits the signal to the control unit, and the control unit comprises a central processing unit for processing signals, and an audio signal output unit for transmitting information to a Bluetooth module or an earphone so as to be recognized by the visually impaired person, wherein the yellow color sensing unit is installed with a color detecting sensor to detect the yellow line in a width that is wider than the width of the Braille block, and is installed with a front detecting sensor, a left detecting sensor and a right detecting sensor in the front and left and right sides of the main body, respectively, and the front detecting sensor and the left and right detecting sensors are connected to a calculator, which is connected to the central processing unit through an A/D converter. To ensure sensing of the yellow color sensing unit 40, the yellow color guide line is painted in the same width of the Braille block in the center of the pedestrian crossing, and the yellow color guide line is painted to be connected to the Braille block on the road. The RFID tag is fixed to the directional switch area and the caution area of the Braille block.

Advantageous Effect

As described above, a road guide apparatus for a visually impaired person according to the present invention not only enables a visually impaired person to read information stored in an RFID tag with a road detector but also senses the yellow color of the Braille blocks to guide the road for the visually impaired person, and helps the visually impaired person easily find the road without sensing the Braille of the Braille blocks and guides the visually impaired person at a fast speed even if the RFID tag reading speed is slow.

Also, if the yellow color alone is installed in a pedestrian crossing or other places where the Braille bocks are hard to install, a visually impaired person may be easily guided.

BEST MODE

Figure 1:
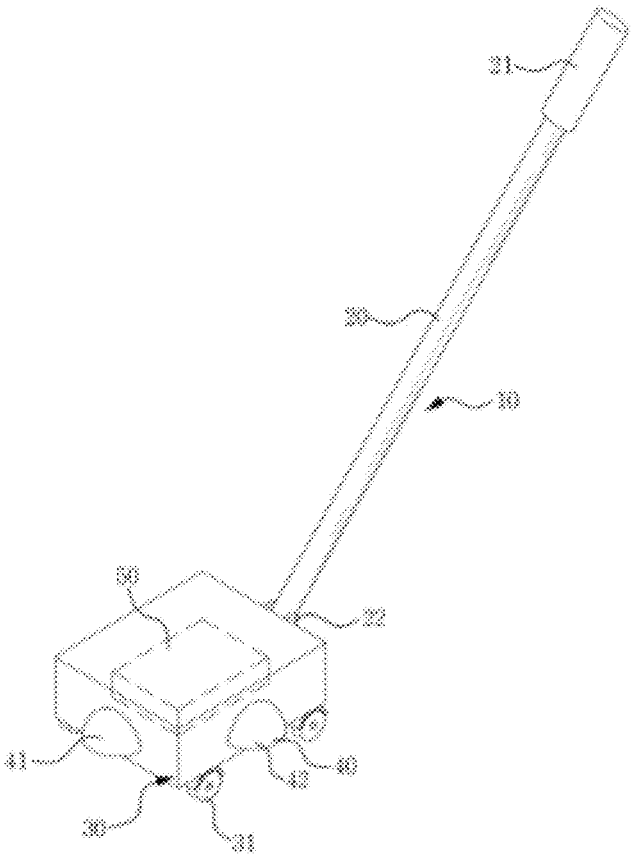
FIG. 1 is a perspective view of a road guide apparatus for a visually impaired person according to the present invention.
Figure 2:
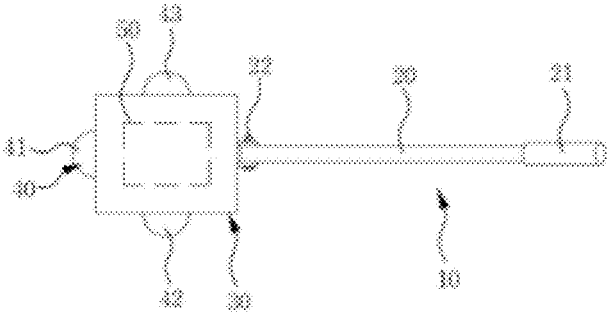
FIG. 2 is a plan view of the road guide apparatus for the visually impaired person according to the present invention.
Figure 3:
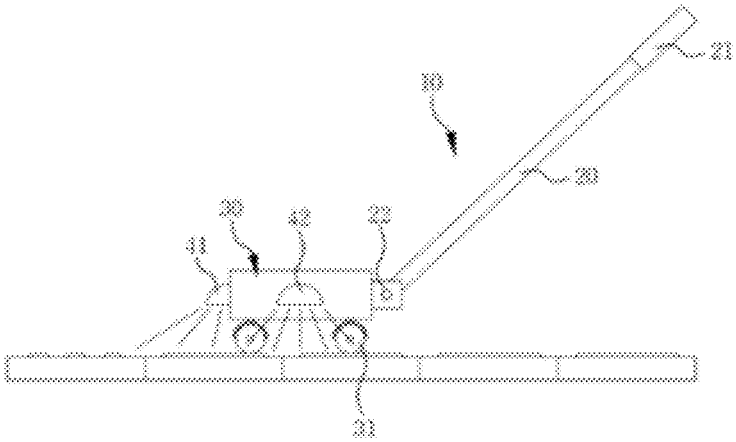
FIG. 3 is a lateral view of the road guide apparatus road guide apparatus for the visually impaired person according to the present invention.
Figure 4:
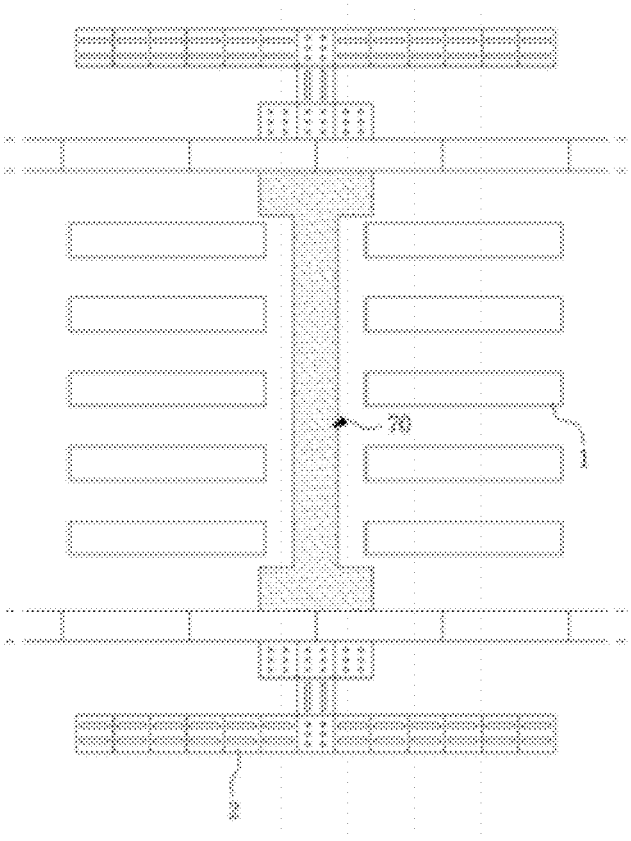
FIG. 4 illustrates a pedestrian crossing where the road guide apparatus for a visually impaired person according to the present invention is used.

Below, exemplary embodiments will be described in detail with reference to accompanying drawings so as to be easily realized by a person having ordinary knowledge in the art. The exemplary embodiments may be embodied in various forms without being limited to the exemplary embodiments set forth herein. Descriptions of well-known parts are omitted for clarity, and like reference numerals refer to like elements throughout.

A road guide apparatus for a visually impaired person which includes a handle and wheels attached to a main body detects the yellow color as the typical color of a Braille block 2 and guides a visually impaired person even if the visually impaired person may not sense the Braille block 2 by himself/herself, and reads detailed information from an RFID tag in a place where direction is switched. In a road sensing apparatus 10, a handle rod 20 is fixed in one side of a main body 30 via a hinge 22, and a control unit 50 is installed within the main body 30, and a front detecting sensor 41, a left detecting sensor 42 and a right detecting sensor 43 are installed in the front and both sides of the main body 30, respectively. A yellow color guide line 70 is painted in a pedestrian crossing 1 so as to be recognized by the yellow color sensing unit 40 and guide the visually impaired person.

In the road sensing apparatus 10, the handle rod 20 is rotatably fixed at one side of a rear end of the main body 30 via the hinge 22, and a handle 21 is formed in an upper end of the handle rod 20 to be easily grabbed by the visually impaired person.

The control unit 50 is formed within the main body 30, and is connected to the yellow color detecting sensor 40 and the tag detecting sensor 60. The yellow detecting sensor 40 is connected to the control unit 50 and senses the yellow color of the Braille block 2 and transmits a signal to the control unit 50. The tag detecting sensor 60 is connected to the control unit 50 and senses a signal of an RFID tag installed on a road and transmits a signal to the control unit 50.

Figure 5:
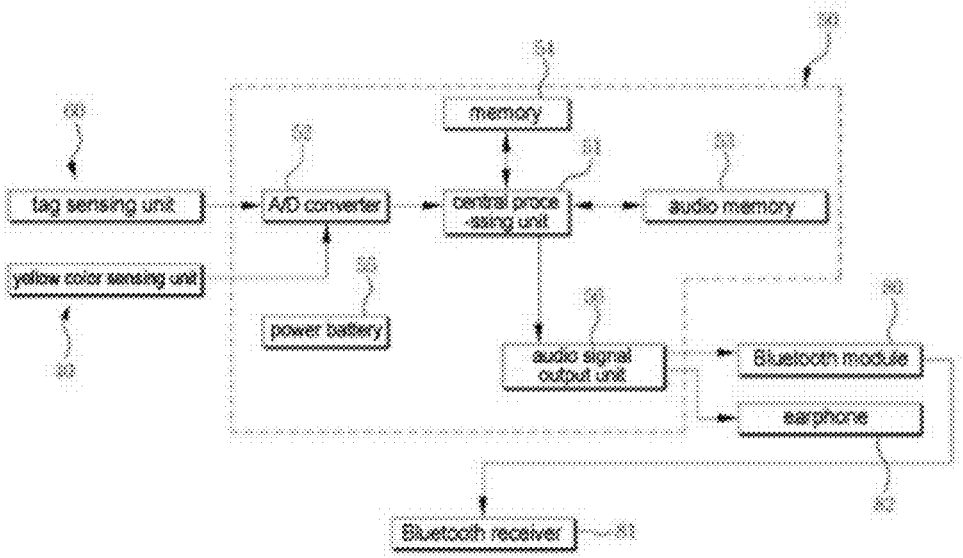
FIG. 5 illustrates a control unit which is used for the road guide apparatus for the visually impaired person according to the present invention.
Figure 6:
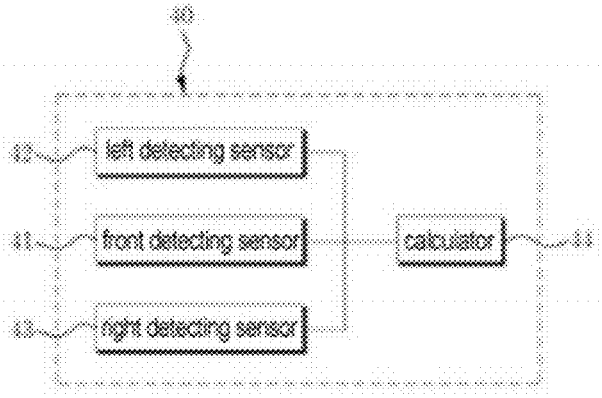
FIG. 6 illustrates a yellow color detecting sensor which is used for the road guide apparatus for the visually impaired person according to the present invention.

As shown in FIG. 5, the control unit 50 has a central processing unit 51 for processing signals, and an audio signal output unit 56 for transmitting information to a Bluetooth module 80 or an earphone 82 so as to be recognized by the visually impaired person. The central processing unit 51 is connected to a memory 54 and an audio memory 53 and receives the content of the RFID tag sensed by the tag sensing unit 60 through an A/D converter 52.

The control unit 50 is connected to the central processing unit 51 and the memory 54 and calculates alarm information within the memory 54 to transmit the information to the audio signal output unit 56. The tag sensing unit 60 which senses a signal of the RFID tag and the yellow color sensing unit 40 which senses the yellow color are connected to the central processing unit 51 via the A/D converter 52. A power battery 55 is built in the control unit 50.

The audio memory 53 stores therein an audio signal and transmits the audio signal to the audio signal output unit 56 according to a signal of the central processing unit 51. The audio signal output unit 56 is connected to the Bluetooth module 80 and performs a short distance wireless communication with the Bluetooth receiver 81 which is put on the ear of the visually impaired person, to notify information of a road.

The yellow color sensing unit 40 is installed with a color detecting sensor to sense a yellow line in a width wider than the width of the Braille block 2. As shown in FIGS. 1 to 4, the yellow color sensing unit 40 is installed with the front detecting sensor 41, the left detecting sensor 42 and the right detecting sensor 43 in the front and left and right sides of the main body 30, respectively.

The front detecting sensor 41 and the left and right detecting sensors 42 and 43 are connected to the calculator 44, which is connected to the central processing unit 51 via the A/D converter 52.

Once located within the width of the Braille block 2, the front detecting sensor 41, the left detecting sensor 42 and the right detecting sensor 43 sense the yellow color and guide the visually impaired person to go straight.

If one of the left and right detecting sensors 42 and 43 does not sense the yellow color, the visually impaired person is guided to move in an opposite direction of the sensor that did not sense the yellow color. If the three sensors sense the yellow color again, the visually impaired person is guided to go straight.

If the front detecting sensor 41 does not sense the yellow color while the visually impaired person goes straight, he/she is guided to move to the left or right.

Accordingly, as all of the three sensors do not sense the yellow color in the yellow line which is narrower in width than the Braille block 2, they do not operate.

To ensure sensing of the yellow color sensing unit 40, the yellow color guide line 70 is painted in the same width of the Braille block 2 in the center of the pedestrian crossing 1, and the yellow color guide line 70 is painted to be connected to the Braille block 2 on the road.

An RFID tag is fixed to the directional switch area and the caution area of the Braille block 2 installed in the starting and ending points of the pedestrian crossing 1, and the road sensing apparatus 10 reads the tag and guides the starting of the pedestrian crossing 1 with an audio.

The invention claimed is:

1. A road guide apparatus for a visually impaired person which comprises a road sensing apparatus comprising a handle and wheels attached to a main body of the road sensing apparatus, a handle rod fixed at the main body via a hinge, and a control unit installed within the main body and connected to a yellow color sensing unit and a tag sensing unit, and the yellow color sensing unit senses the yellow color of a Braille block or a yellow line and transmits a signal to the control unit, and the tag sensing unit senses a signal of the RFID tag installed on the road and transmits the signal to the control unit, and the control unit comprises a central processing unit for processing signals, and an audio signal output unit for transmitting information to a Bluetooth module or an earphone so as to be recognized by the visually impaired person, wherein the yellow color sensing unit 40 is installed with a color detecting sensor to detect the yellow line in a width that is wider than the width of the Braille block 2, and is installed with a front detecting sensor 41, a left detecting sensor 42 and a right detecting sensor 43 in the front and left and right sides of the main body, respectively, and the front detecting sensor and the left and right detecting sensors 42 and 43 are connected to a calculator 44, which is connected to the central processing unit 51 through an A/D converter 52.

* * * * *